US007098863B2

(12) United States Patent
Bancroft

(10) Patent No.: US 7,098,863 B2
(45) Date of Patent: Aug. 29, 2006

(54) MICROSTRIP ANTENNA

(75) Inventor: Randy Bancroft, Denver, CO (US)

(73) Assignee: Centurion Wireless Technologies, Inc., Lincoln, NE (US)

( * ) Notice: Subject to any disclaimer, the term of this patent is extended or adjusted under 35 U.S.C. 154(b) by 0 days.

(21) Appl. No.: 10/907,964

(22) Filed: Apr. 22, 2005

(65) Prior Publication Data

US 2005/0237260 A1 Oct. 27, 2005

Related U.S. Application Data

(60) Provisional application No. 60/565,032, filed on Apr. 23, 2004.

(51) Int. Cl.
*H01Q 1/50* (2006.01)
*H01Q 1/38* (2006.01)
*H01Q 9/28* (2006.01)

(52) U.S. Cl. ..... 343/859; 343/700 MS; 343/795

(58) Field of Classification Search ..... 343/700 MS, 343/795, 850, 853, 859
See application file for complete search history.

(56) References Cited

U.S. PATENT DOCUMENTS 5,229,777 A * 7/1993 Doyle ..... 343/700 MS
6,593,886 B1 * 7/2003 Schantz ..... 343/700 MS
6,933,907 B1 * 8/2005 Shirosaka et al. ..... 343/810
6,987,483 B1 * 1/2006 Tran ..... 343/700 MS

* cited by examiner

*Primary Examiner*—Shih-chao Chen
(74) *Attorney, Agent, or Firm*—Holland & Hart

(57) ABSTRACT

An antenna is provided having a relatively wide bandwidth of operation. The antenna may be a printed circuit board dipole antenna having a ladder balun feed network coupled to a ground plane and dipole radiating elements located about one-quarter wavelength from an edge of the ground plane. The ground plane acts as a reflector to increase antenna gain. A plurality of the antennas may be provided in an array configuration with antennas being located in relatively close proximity and being isolated from other antennas in the array. An array of antennas may be used to provide a wireless link in a wireless network utilizing a IEEE 802.1X frequency band.

19 Claims, 3 Drawing Sheets

MICROSTRIP ANTENNA

CROSS-REFERENCE TO RELATED APPLICATIONS

This application claims the benefit of U.S. Provisional Patent Application No. 60/565,032, filed on Apr. 23, 2004, entitled "MICROSTRIP ANTENNA", the entire disclosure of which is hereby incorporated by reference.

FIELD OF THE INVENTION

The present invention relates to a microstrip antenna and, more particularly, to a microstrip dipole antenna having a ladder balun feed.

BACKGROUND OF THE INVENTION

Printed circuit board, dipole antennas are good functional antennas, but tend to operate in relatively narrow bandwidths. The narrow bandwidth of operation causes printed circuit board, dipole antennas to have limited usefulness in devices required to operate over large bandwidths, such as the IEEE 802.11a frequency band, which is 5.15 to 5.85 GHz. Thus, it would be desirous to construct a printed circuit board, dipole antenna having a wide bandwidth of operation.

SUMMARY OF THE INVENTION

The present invention provides an antenna having a relatively wide bandwidth of operation. The antenna may be a printed circuit board dipole antenna having a ladder balun feed network coupled to a ground plane and dipole radiating elements located about one-quarter wavelength from an edge of the ground plane. The ground plane acts as a reflector to increase antenna gain. A plurality of the antennas may be provided in an array configuration with antennas being located in relatively close proximity and being isolated from other antennas in the array. In one embodiment, an array of antennas is used to provide a wireless link in a wireless network utilizing a IEEE 802.1X frequency band.

In one embodiment, an antenna is provided that comprises (a) a power feed network; (b) a ground plane located in proximity to the power feed network and separated therefrom by a dielectric material and electrically coupled thereto when an RF signal is provided to the power feed network; and (c) a plurality of radiating elements operably interconnected with the power feed network and operable to transmit and receive RF signals having frequencies in a predetermined frequency range. The frequency range has a center frequency and each of the radiating elements is interconnected with the feed network and located approximately one-quarter wavelength from an edge of the ground plane at the center frequency. The ground plane is operable to act as a reflector relative to the radiating elements over the frequency range thereby providing enhanced gain for the antenna over the frequency range.

The power feed network of an embodiment comprises a ladder balun feed element operably interconnected with a RF feed, and a twin lead transmission line, each lead operably interconnected with a side of the ladder balun feed element. The ladder balun feed element may have a first leg having a feed end operably interconnected to the RF feed and a second leg spaced apart from the first leg and operably interconnected to the first leg by at least a first and a second connecting element. Each of the first and second connecting elements may have a length of approximately one-half wavelength of the center frequency in the dielectric. Alternatively, the first connecting element may have a first length and the second connecting element may have a second length that is greater than the first length, the first and second legs thus diverging from each other relative to the feed point.

In another embodiment, the plurality of radiating elements comprises a first dipole element connected to a first lead of the twin lead transmission line, and a second dipole element connected to a second lead of the twin lead transmission line. The first and second dipole elements may be substantially symmetrical, although this is not necessary.

Yet another embodiment of the invention provides an array of antennas comprising a plurality of antennas with each of the antennas having approximately 5 dBi of gain and an impedance bandwidth that extends over a frequency range from approximately 5.15 GHz to approximately 5.85 GHz, and where each of the plurality of antennas are located in close proximity to other of the antennas and have at least approximately −20 dB isolation between each of the antennas. Each of the antennas, in an embodiment, comprises (i) a feed network comprising a two-element half-wave ladder balun which provides anti-phase currents to an unbalanced twin lead transmission line; (ii) a ground plane located in proximity to the feed network and separated therefrom by a dielectric material and electrically coupled thereto when an RF signal is provided to the feed network; and (iii) dipole radiating elements operably interconnected to each of the twin lead transmission lines. Each of the antennas may be included on a single printed circuit board.

The foregoing and other features, utilities and advantages of the invention will be apparent from the following more particular description of a preferred embodiment of the invention as illustrated in the accompanying drawings.

BRIEF DESCRIPTION OF THE DRAWINGS

The accompanying drawings, which are incorporated in and constitute a part of this specification, illustrate embodiments of the present invention, and together with the description, serve to explain the principles thereof. Like items in the drawings are referred to using the same numerical reference.

DETAILED DESCRIPTION

Figure 1:
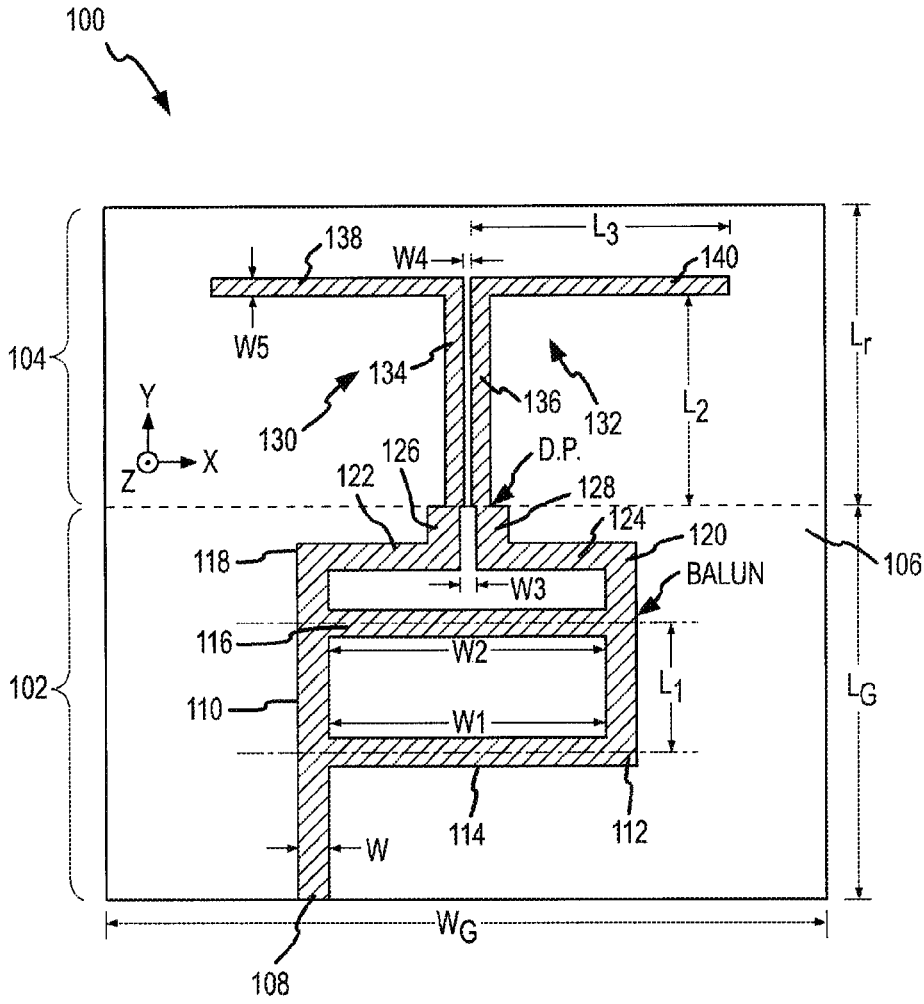
FIG. 1 is an illustration of an antenna of an embodiment of the invention.

The present invention will be described with reference to the present invention. Referring first to FIG. 1, a microstrip antenna 100 is shown. Microstrip 100 includes a power feed network 102 and a plurality of radiating elements 104. Power feed network 102 is coupled to a ground plane 106. Power feed network 102 is shown as a ladder balun. The ladder balun feed has a feed point 108, a first leg 110, and a second leg 112. While the legs are shown as substantially parallel, legs 110 and 112 can converge or diverge from feed point 108 for different effects. Feed point 108 is connected to a feed end of first leg 110. As shown, a first connecting element 114 of a length W1 connects first leg and second leg at a feed end of second leg 112. A second connecting element 116 connects first leg and second leg as well. Because legs 110 and 112 are substantially parallel, second connecting element 116 has a length W2. Length W2 is equal to W1 for the case where legs 110 and 112 are substantially parallel, but could be greater or less than W1 for the divergent or convergent legs as the case may be. Second connecting element 116 is a distance L1 from first connecting element 114. The lengths L1 can vary between connecting elements. While two connecting elements are shown, more or less connecting elements are possible as a matter of design choice. Increasing the number of connecting elements generally increases the bandwidth of antenna 100. First leg 110 terminates in a termination point 118 and second leg terminates in a termination point 120 slightly beyond the last connecting element, which in this case is second connecting element 116.

Twin transmission lines 122, 124 converge from termination points 118 and 120 to twin radiating feed points 126, 128 respectively. Twin radiating feed points 126, 128 are separated by a distance W3. The width W3 facilitates the transition from a pair of microstrip transmission lines which, in one embodiment, are 180 degrees out of phase to a section of balanced twin lead transmission lines which feeds the dipole radiator 138 and 140. Radiating feed points 126, and 128 are connected to symmetrical radiating elements, which are shown in this case as dipole antennas 130 and 132. While dipoles are shown, other types of radiating elements may be used, such as a folded dipole, a Yagi-Uda antenna with the addition of a passive element, a vee shaped antenna, or the like. Symmetrical dipole antenna elements 130 and 132 have first radiating legs 134, 136 of a length L2 that form a balanced twin lead transmission line without a ground plane, which transition the two 180 degree phase difference microstrip transmission lines 126 and 128 with ground plane radiating elements 138 and 140, which have a length L3. The lengths of 138 and 140 determine the resonant frequency of the antenna. Legs 138 and 140 have a width W5, that can have an effect on the antenna matching. Legs 138 and 140 have a width of W5, for convenience in this case, but are not restricted to W5. The legs 138 and 140 may be equal in length, but this is also not required and the lengths may be adjusted to better suit a particular application. Legs 134 and 136 are separated by a distance W4.

Ground plane 106 has a width Wg, a length Lg, and a length Lr. Length Lg is generally the length of the microstrip power feed network 102 from feed point 108 to twin microstrip transmission lines 126 and 128 which are anti-phase (i.e. 180 degrees out of phase) which is the required phasing to transition to twin lead transmission line 134 and 136 which has no physical ground plane but possesses a virtual ground between the two lines 134 and 136. Length Lr is the remainder of the circuit board which has metal conductors 134, 136, 138, and 140 only on the upper surface without any ground plane backing. A dielectric substrate resides over the entire length Lg and Lr, but ground plane 106 only exists in the area defined by Wg and Lg. The edge of ground plane 106 at the boundary of Lg and Lr acts as a reflector, which can increase the gain of the antenna and provide direction to the radiation pattern.

First leg 110, second leg 112, first connecting element 114 and second connecting element 116 all have a width W. Width W is selected using techniques that are known in the art and will not be further explained herein. It has been found, however, that selecting a width to provide a 50 Ohm transmission line works well. Length L1 separating first connecting element 114 and second connecting element 116 is preferably approximately ¼ wavelength in the dielectric. For parallel legs, lengths W1 and W2 are preferably approximately ½ wavelength in the dielectric. For convergent or divergent legs, the distances should be as required to form, for example, a log-periodic balun.

The widths of W3–W5 may vary to change twin radiating feed points 126, 128 impedance, and to a lesser extend the dipole input impedance. This variation provides, in part, impedance matching. Length L2 generally is approximately ¼ wavelength in free space at the center operating band. Length L3 generally is approximately ¼ wavelength in free space at the center operating band. L2 and L3 can be varied in accordance with conventional dipole methodologies, which relate to frequency of operation.

Figure 2:
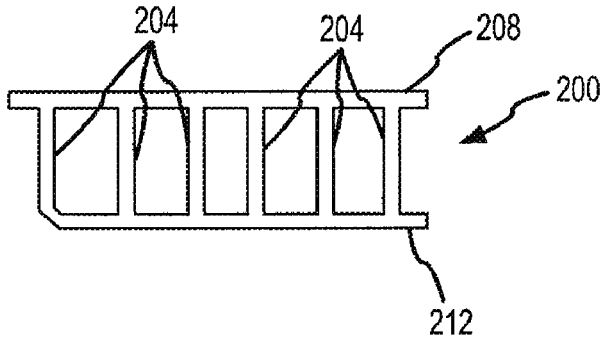
FIG. 2 is an illustration of a feed network of another embodiment of the invention.

Referring now to FIG. 2, a feed network 200 of another embodiment of the invention is illustrated. In this embodiment, the ladder balun feed network 200 has six connecting elements 204 connecting a first leg 208 to a second leg 212. The connecting elements 204 of this embodiment are spaced evenly along the first and second legs 208, 212. The distance between connecting elements 204 is one-quarter wavelength, although this distance may be adjusted based on the application in which the antenna incorporating the feed network 200 will be used. Furthermore, connecting elements may unevenly be spaced along the first and second legs 208, 212.

Figure 3:
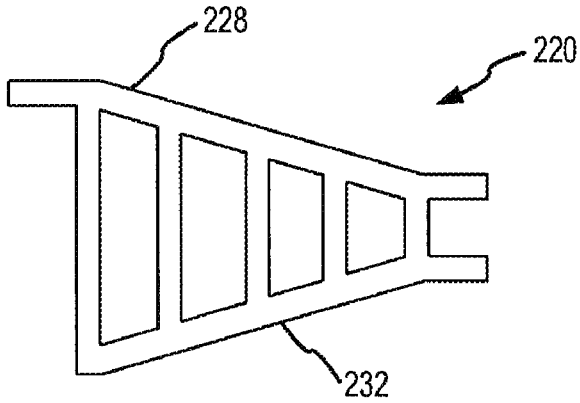
FIG. 3 is an illustration of a log-periodic feed network of an embodiment of the invention.
Figure 4:
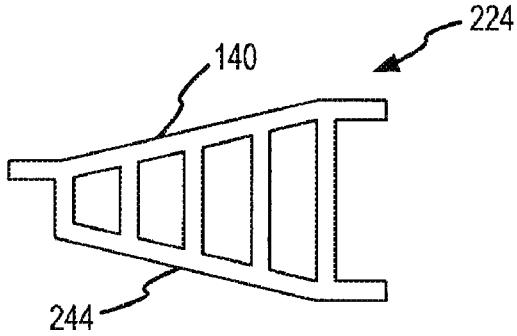
FIG. 4 is an illustration of a log-periodic feed network of another embodiment of the invention.

FIGS. 3 and 4 illustrate log-periodic balun feed networks 220, 224, of other embodiments of the invention. As illustrated in FIG. 3, a first leg 228 and a second leg 232 may be converging legs that converge between the feed point and transmission lines. As illustrated in FIG. 4, a first leg 240 and second leg 244 may diverge from the feed point to the transmission lines.

Figure 5:
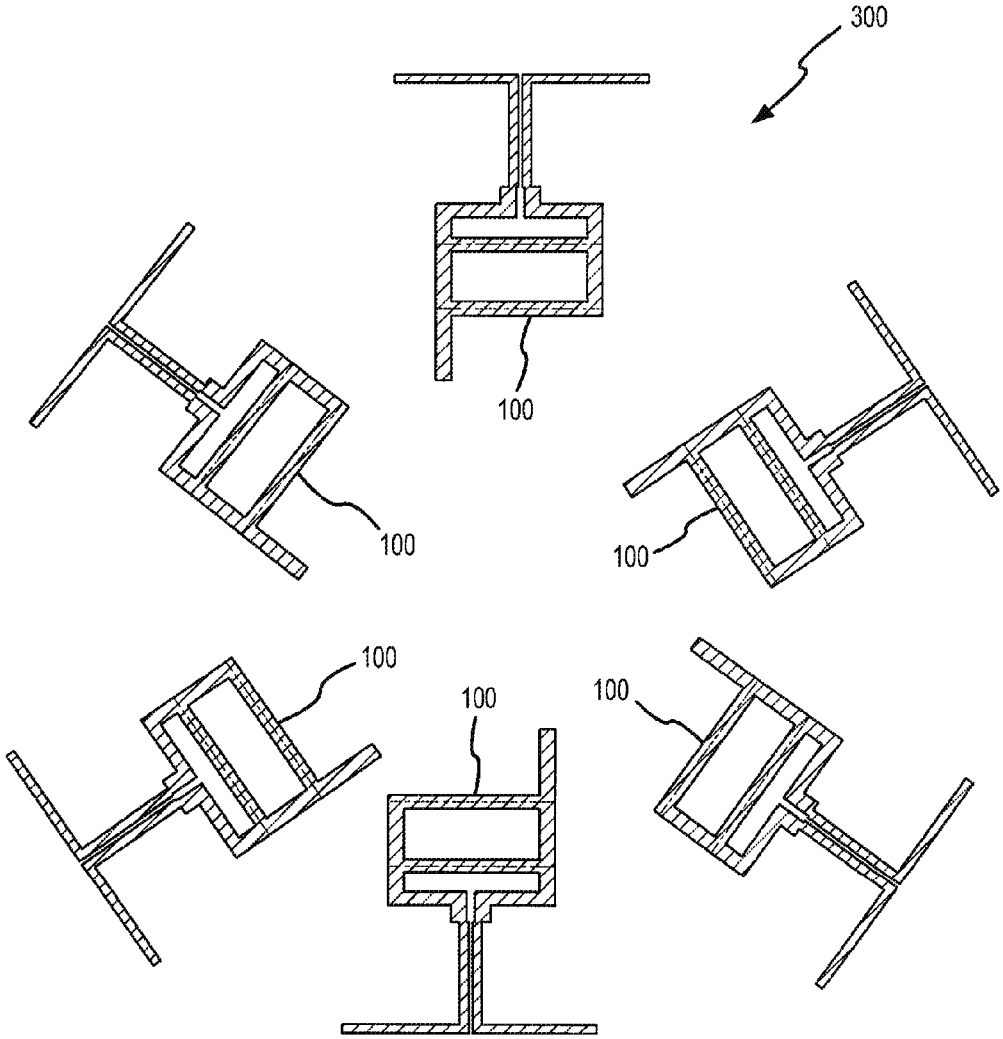
FIG. 5 is an illustration of an array of antennas of another embodiment of the invention.

Antennas as described herein can be used in an array of antennas 300, as shown in FIG. 5. As illustrated in FIG. 5, array 300 comprises a plurality of antennas 100, in this case six (6) antennas 100. More or less antennas 100 are possible. The number of antennas included in the array is largely a function of the desired diversity pattern coverage or gain in the case of a phased array design. While array 300 is shown as a circular array, which facilitates multiple diversity operation, other arrangements of antennas 100 within an array are possible, such as, for example, a square array, rectangular array, elliptical array, a random shaped array, or the like. In one embodiment, the antenna 100 within the array 300 are located in relatively close proximity to other antennas in the array 300. Thus, the array 300 is relatively compact, as may be desirable in many applications. In this embodiment, each of the antennas 100 is an antenna as described with respect to FIG. 1, and the array 300 operates over a frequency range of about 5.15–5.85 GHz. However, it will be understood that other types of antennas may be used in such an array 300. In this embodiment, each of the antennas 100 has approximately 5 dBi of gain, and there is at least about −20 dB isolation between each of the antenna elements 100. As mentioned above, the antennas 100 may be located in relatively close proximity to other antennas 100 in the array 300 and, in an embodiment, the elements within an antenna 100 may be located within approximately one to two wavelengths of elements of other antennas 100 at the center frequency. In one embodiment, the array of antennas 200 is used in a system that provides a wireless link in an IEEE 802.1X network.

While the invention has been particularly shown and described with reference to an embodiment thereof, it will be understood by those skilled in the art that various other changes in the form and details may be made without departing from the spirit and scope of the invention.

What is claimed is:

1. An antenna, comprising:

a power feed network comprising:

a ladder balun feed element operably interconnected with a RF feed;

a twin lead transmission line, each lead operably interconnected with a side of said ladder balun feed element;

a ground plane located in proximity to said power feed network and separated therefrom by a dielectric material and electrically coupled thereto when an RF signal is provided to said power feed network;

a plurality of radiating elements operably interconnected with said power feed network and operable to transmit and receive RF signals having frequencies in a predetermined frequency range, said frequency range having a center frequency, each of said radiating elements operably interconnected with one of said twin lead transmission line, and wherein said ground plane is operable to act as a reflector relative to said radiating elements over said frequency range thereby providing enhanced gain for the antenna over said frequency range.

2. The antenna, as claimed in claim 1, wherein said ladder balun feed element comprises:

a first leg having a feed end operably interconnected to said RF feed;

a second leg spaced apart from said first leg and operably interconnected to said first leg by at least a first and a second connecting element.

3. The antenna, as claimed in claim 2, wherein each of said first and second connecting elements have a length of approximately one-half wavelength of said center frequency in said dielectric material.

4. The antenna, as claimed in claim 2, wherein said first connecting element has a first length and said second connecting element has a second length that is greater than said first length, said first and second legs thus diverging from each other relative to said feed point.

5. The antenna, as claimed in claim 2, wherein said first connecting element connects said first and second legs at a first distance from said feed point, and said second connecting element connects said first and second legs at a second distance from said feed point, wherein said first and second distances are selected based on a desired bandwidth for the antenna.

6. The antenna, as claimed in claim 5, wherein a difference between said first and second distances is approximately one-quarter wavelength of said center frequency in said dielectric material.

7. The antenna, as claimed in claim 1, wherein said plurality of radiating elements are located approximately one-quarter wavelength from an edge of said ground plane at said center frequency.

8. The antenna, as claimed in claim 1, wherein said plurality of radiating elements comprises:

a first dipole element connected to a first lead of said twin lead transmission line; and a second dipole element connected to a second lead of said twin lead transmission line.

9. The antenna, as claimed in claim 8, wherein said first and second dipole elements are substantially symmetrical.

10. The antenna, as claimed in claim 8, wherein each of said twin lead transmission lines provide a RF signal that is approximately one-half wavelength out-of-phase relative to the other twin lead transmission line.

11. The antenna, as claimed in claim 8, wherein said first and second dipole elements each comprise:

a radiating leg that forms a transmission line without a ground plane; and a radiating element operably interconnected with said radiating leg, said radiating element and radiating leg having a width selected to provide a desired input impedance for said dipole elements.

12. An array of antennas, comprising:

a plurality of antennas, each comprising:

a feed network comprising a ladder balun which provides anti-phase currents to an unbalanced twin lead transmission line;

a ground plane located in proximity to said feed network and separated therefrom by a dielectric material and electrically coupled thereto when a RF signal is provided to said feed network; and dipole radiating elements operably interconnected to each of said twin lead transmission lines, wherein each of said antennas have approximately 5 dBi of gain and an impedance bandwidth that extends over a frequency range from approximately 5.15 GHz to approximately 5.85 GHz, and wherein each of said plurality of antennas are located in close proximity to other of said antennas and have at least approximately −20 dB isolation between each of said antennas.

13. The array of antennas, as claimed in claim 12, wherein each of said antennas is included on a single printed circuit board.

14. The array of antennas, as claimed in claim 12, wherein each of said dipole radiating elements is located less than about two wavelengths of a center operating frequency of the array from another radiating element of another antenna within the array.

15. The array of antennas, as claimed in claim 12, wherein said dipole radiating elements of each of said antennas is approximately one-quarter wavelength from said ground plane.

16. The array of antennas, as claimed in claim 12, wherein each of said antennas is arranged in a planar array, and wherein the array is capable of providing multiple diversity operation.

17. The array of antennas, as claimed in claim 12, wherein said ladder balun of each of said antennas comprises a two-element half-wave ladder balun.

18. The array of antennas, as claimed in claim 17, wherein said two-element half-wave ladder balun of each of said antennas comprises:

a first leg having a feed end operably interconnected to an array RF feed; and a second leg spaced apart from said first leg and operably interconnected to said first leg by at least a first and a second connecting element.

19. The array of antennas, as claimed in claim 18, wherein each of said first and second connecting elements have a length of approximately one-half wavelength of a center frequency of said frequency range in said dielectric material.

* * * * *